United States Patent [19]

Rennie et al.

[11] Patent Number: 4,787,998

[45] Date of Patent: Nov. 29, 1988

[54] FRAGRANT LIQUID CLEANING COMPOSITION

[75] Inventors: George K. Rennie; Paul D. Hardman, both of Bebington, Great Britain

[73] Assignee: Lever Brothers Company, New York, N.Y.

[21] Appl. No.: 28,030

[22] Filed: Mar. 18, 1987

Related U.S. Application Data

[63] Continuation-in-part of Ser. No. 772,289, Sep. 4, 1985, abandoned.

[30] Foreign Application Priority Data

Sep. 5, 1984 [GB] United Kingdom ..... 8422372

[51] Int. Cl.[4] ..... C11D 3/50

[52] U.S. Cl. ..... 252/174.11; 252/174.23; 252/DIG. 2

[58] Field of Search ..... 252/522 R, DIG, 2, 174.11, 252/174.23

[56] References Cited

U.S. PATENT DOCUMENTS 4,465,619 8/1984 Boskamp ..... 252/540

*Primary Examiner*—James H. Reamer

*Attorney, Agent, or Firm*—Milton L. Honig; James J. Farrell

[57] ABSTRACT

The invention pertains to fragrant aqueous liquid detergent compositions. By the inclusion therein of shear thinning polymers, having viscosities within defined ranges, improved products are obtained which, when compared with fragrant compositions with other polymers, show an improved longevity of the fragrance, even at a reduced perfume level.

7 Claims, No Drawings

FRAGRANT LIQUID CLEANING COMPOSITION

This is a continuation-in-part application of Ser. No. 772,289, filed Sept. 4, 1985, now abandoned.

The present invention relates to fragrant liquid cleaning compositions. More particularly it relates to thickened fragrant liquid cleaning compositions with longer lasting olfactory properties.

Liquid cleaning compositions which contain a perfume are well known in the art. They are formulated and used for a variety of purposes, mainly for general purpose cleaning, such as the cleaning of hard surface, e.g. tiles, kitchen sinks, floors, baths, lavatories, etc. For particular purposes, such as bathrooms, lavatories, etc. often a higher level of perfume is included in such cleaning compositions in order to achieve a fragrant atmosphere in such places.

However, the fragrance thus provided is often only of relatively short lifetime, as the perfume evaporates into the air and is, as it were, diluted by the air. Moreover, often the cleaning composition has only a short residence time on the substrate to be cleaned, thus leaving relatively little time for the perfume to evaporate and impart a pleasant fragrance to the substrate and its surroundings. If the cleaning operation is followed by a rinsing step, whereby the cleaning composition is removed, this causes a further reduction of the residence time of the perfume present on the surface of the substrate.

It is an object of the present invention to increase the residence time of the fragrant cleaning composition on the surface of the substrate treated therewith and reduce drainage losses by subsequent rinsing.

It is another object of the present invention to reduce the level of perfume in such liquid cleaning compositions while maintaining or even improving the longevity of the fragrance imparted to the substrate and its surroundings.

It has now been found that these and other objects of the invention can be achieved by inclusion of the perfume in a liquid cleaning composition which is shear thinning. Such shear thinning liquid cleaning compositions are obtained according to the present invention by inclusion in an aqueous liquid surface-active agent-containing cleaning composition of a polymer which is shear thinning, thus causing the product containing this polymer to be sufficiently thick when draining but sufficiently thin when being dispensed from the container.

The polymer should have a viscosity, at 25° C. in deionised water at a polymer concentration of 3% by weight or less, of between 0.3 and 0.006 Pa.S, preferably between 0.15 and 0.006 Pa.s and particularly preferably between 0.04 and 0.006 Pa.s, at a shear rate of 2000 $sec^{-1}$, and at a shear rate of 30 $sec^{-1}$ a viscosity of between 0.7, preferably 0.5 and particularly preferably 0.3 Pa.s and 0.03 Pa.s, and a viscosity at a shear rate of 0.5 $sec^{-1}$ of between 0.6 Pa.s, preferably 1.1 Pa.s and particularly preferably 2.0 Pa.s and 50 Pa.s.

The polymer should furthermore be compatible with the surface-active agents present in the cleaning composition. Suitable examples of polymers to be used according to the present invention are biopolymers such as the xanthan gums and derivatives thereof, such as Kelzan S, a partially acetylated xanthan gum ex Kelco Co., Shellflo-XA ex Shell Chemicals Ltd, Enorflo-XA ex Shell Chemicals, Rhodapol ex Rhöne-Poulenc, cross-linked polyacrylates, such as Carbopol ex B. F. Goodrich Co. Ltd, succinoglucane, such as Shellflo-S ex Shell Chemicals Ltd, acrylic copolymers such as E.P. 1996 ex National Adhesives and Resins Ltd.

The amount of polymer used in the cleaning composition generally ranges from 0.1–3.0%, usually from 0.25–1.0%, and preferably from 0.4–0.8 by weight. The liquid cleaning composition comprises furthermore as essential ingredients one or more detergent active materials which can be anionic, nonionic and zwitterionic type detergent actives or mixtures thereof. Usually anionic synthetic detergents, such as the alkylbenzene sulphonates, alkanesulphonates, alkylsulphates, alkylethersulphates or mixtures thereof can be used. A typical example thereof is a mixture of sodium dodecyl benzenesulphonate and a sodium salt of a sulphated $C_{12}$–$C_{15}$ primary linear alcohol condensed with 3 moles of ethylene oxide. In general the amount of active detergent material in the composition ranges from 0.05–20%, usually from 0.1–15% and preferably from 2–10% by weight.

Another essential ingredient of the cleaning composition is a perfume, by which is to be understood either a single fragrant compound or a mixture of various compounds. Any type of perfume may be used. The amount of perfume in the composition may vary from 0.1–1.5%, usually from 0.2–1.0% and preferably from 0.25–0.8%.

Furthermore, other ingredients commonly encountered in such compositions may also optionally be included, such as builders, sequestering agents, dyes, preservatives, bleaches, bleach activators, solvents, enzymes, foam controlling agents, hydrotropes and so on. The liquid medium of the composition usually is an aqueous medium.

The compositions of the present invention contain none or very small amounts of builder, usually in the range of from 0 to 0.5% by weight of builder. Moreover, the compositions of the present invention have as their major ingredient water. These compositions will contain greater than 75% by weight of water, usually more than 85%, preferably greater than about 95% water.

The invention will further be illustrated by way of Example.

EXAMPLE 1

The following formulations were prepared.

| | % by weight | |
|---|---|---|
| | A | B |
| Sodium alkylbenzenesulphonate | 1.8 | 1.8 |
| Sodium salt of sulphated $C_{12}$–$C_{15}$ linear primary alcohol condensed with 3 moles of ethylene oxide | 1.8 | 1.8 |
| Perfume | 1.0 | 1.0 |
| Industrial Methylated Spirit | 4.0 | 4.0 |
| Dye | 0.007 | 0.007 |
| Sodium hexametaphosphate | 0.5 | 0.5 |
| Formalin | 0.5 | 0.5 |
| Polymer | 0.52 | 0.6 |
| Water | ad 100 | ad 100 |

In formulation A the polymer was Natrosol 250 HBR, a cellulose-based polymer ex Hercules, Inc. and in formulation B the polymer was Kelzan S. The latter polymer had the following viscosity (0.6% in deionised water at 25° C.): 0.014 Pa.s ($\gamma$=2000 $sec^{-1}$), 0.4 Pa.s ($\gamma$=30 $sec^{-1}$) and 8 Pa.s ($\gamma$=0.5 $sec^{-1}$).

The concentration of the polymers was chosen to match the dispensing characteristics of both formulations.

These formulations were compared in the following manner: On to ceramic tiles, 15 g of each product was dosed and the tiles were placed in a vertical position to allow the products to drain. After half an hour, only 6% of formulation A remained on the tile, whereas 43% of formulation B was still present on the tile.

In another experiment, plastic tiles were immersed in the test products and then drained vertically from 1 hour without any further ventilation. The perfume impact was then assessed by a panel using a magnitude estimation (ME) technique. With formulation A, an ME of the perfume strength of 80 was reached, whereas with formulation B the perfume strength was assessed to have an ME of 130.

The results thereof showed that the Kelzan-containing formulation produced a significantly longer lasting perfume intensity.

EXAMPLE 2

The following formulation equally produced a longer lasting perfume intensity, and imparted a glossy appearance to the hard surfaces treated therewith:

| | % by weight |
|---|---|
| Sodium alkylbenzenesulphonate | 0.25 |
| Sodium salt of sulphonated $C_{12}$–$C_{15}$ linear primary alcohol condensed with 3 moles of ethylene oxide | 0.25 |
| Linear primary $C_9$–$C_{11}$ alcohol, condensed with 5 moles of ethylene oxide | 1.0 |
| Perfume | 0.7 |
| Dye | 0.01 |
| Formalin | 0.75 |
| Polymer | 1.0 |
| Water | balance |

The polymer was an acrylic copolymer, obtainable from National Adhesives and Resins Ltd under the name E.P. 1996. This copolymer has the following viscosities (0.9% in deionised water at 25° C.):

| | | |
|---|---|---|
| at $\gamma$ = | 2000 $sec^{-1}$ | 0.036 Pa.s |
| $\gamma$ = | 30 $sec^{-1}$ | 0.17 Pa.s |
| $\gamma$ = | 0.5 $sec^{-1}$ | 1 Pa.s |

In the above examples, the viscosities were measured with a Haake RV 2 rheoviscometer.

What is claimed is:

1. A fragrant aqueous liquid cleaning composition comprising from 0.05–20% by weight of one or more surface-active detergents, from 0.1–1.5% by weight of one or more perfumes, from about 0–0.5% by weight of a builder, greater than 75% water and from 0.1–3% by weight of one or more polymers in an aqueous medium, wherein the polymer is an acrylic copolymer that is shear thinning, having a viscosity, at 25° C. in deionised water at a concentration of 3% by weight or less, of between 0.3 and 0.006 Pa.s at a shear rate of 2000 $sec^{-1}$, of between 0.7 and 0.03 Pa.s at a shear rate of 30 $sec^{-1}$, and of between 0.6 and 50 Pa.s at a shear rate of 0.5 $sec^{-1}$.

2. A composition according to claim 1, wherein the polymer has the following viscosities:
between 0.15 and 0.006 Pa.s at 2000 $sec^{-1}$,
between 0.5 and 0.03 Pa.s at 30 $sec^{-1}$ and
between 1.1 and 50 Pa.s at 0.5 $sec^{-1}$.

3. A composition according to claim 1, wherein the polymer has the following viscosities:
between 0.04 and 0.006 Pa.s at 2000 $sec^{-1}$,
between 0.3 and 0.03 Pa.s at 30 $sec^{-1}$ and
between 2.0 and 50 Pa.s at 0.5 $sec^{-1}$.

4. A composition according to claim 1, wherein it contains 0.25–1% by weight of the polymer and 0.25–0.8% of the perfume.

5. A composition according to claim 1, wherein the polymer is a xanthan gum or a derivative thereof.

6. A composition according to claim 1, wherein the surface-active detergents are exclusively anionic.

7. A composition according to claim 1 wherein the amount of water present is greater than 85% by weight.

* * * * *